US005622666A

United States Patent [19]

Struszczyk et al.

[11] Patent Number: 5,622,666

[45] Date of Patent: Apr. 22, 1997

[54] MODIFIED VISCOSE FIBRES AND METHOD FOR THEIR MANUFACTURE

[75] Inventors: Henryk Struszczyk, Zgierz, Poland; Pertti Nousiainen; Olli Kivekäs, both of Tampere, Finland; Antoni Niekraszewicz, PL-Lodz, Poland

[73] Assignee: Novasso Oy, Tampere, Finland

[21] Appl. No.: 411,782

[22] PCT Filed: Oct. 11, 1993

[86] PCT No.: PCT/FI93/00412

§ 371 Date: Jun. 7, 1995

§ 102(e) Date: Jun. 7, 1995

[87] PCT Pub. No.: WO94/09192

PCT Pub. Date: Apr. 28, 1994

[30] Foreign Application Priority Data

Oct. 9, 1992 [FI] Finland ..... 924408

[51] Int. Cl.[6] ..... D01D 5/06; D01F 2/10

[52] U.S. Cl. ..... 264/191; 106/166.01

[58] Field of Search ..... 264/188, 191; 106/164, 165, 168, 166.01; 536/56

[56] References Cited

U.S. PATENT DOCUMENTS

| | | | |
|---|---|---|---|
| 4,309,534 | 1/1982 | Austin | 536/20 |
| 4,464,321 | 8/1984 | Pittalis et al. | 264/83 |

FOREIGN PATENT DOCUMENTS

| | | | |
|---|---|---|---|
| 77098 | 4/1983 | European Pat. Off. . | |
| 78126 | 2/1989 | Finland . | |
| 78127 | 2/1989 | Finland . | |
| 56-106901 | 8/1981 | Japan . | |
| 56-112937 | 9/1981 | Japan . | |
| 59-116418 | 7/1984 | Japan . | |
| 60-40224 | 3/1985 | Japan . | |
| 60-59123 | 4/1985 | Japan . | |
| 125995 | 5/1984 | Poland . | |
| 1588647 | 4/1981 | United Kingdom . | |
| 2062652 | 5/1981 | United Kingdom . | |
| WO91/09163 | 6/1991 | WIPO | 264/191 |

*Primary Examiner*—Leo B. Tentoni
*Attorney, Agent, or Firm*—Pollock, Vande Sande & Priddy

[57] ABSTRACT

Modified viscose fibres comprise regenerated cellulose and contain in their structure microcrystalline chitosan bound mainly by hydrogen bonds with the regenerated cellulose of viscose fibres. To improve the properties of the fibres the modified fibres contain as a third component a water-soluble and/or alkali-soluble natural polymer or a derivative thereof of polysaccharide origin containing groups bound by hydrogen and/or ionic bonds with the microcrystalline chitosan. Examples of such polymers are alginic acid, sodium and potassium alginate and sodium carboxymethycellulose.

21 Claims, No Drawings

MODIFIED VISCOSE FIBRES AND METHOD FOR THEIR MANUFACTURE

The present invention relates to modified viscose fibres and method for their manufacture.

Up to now viscose fibres containing chitosan and chitin/chitosan fibres have been manufactured using a viscose method. Chitin or chitosan is mercerized and reacted with carbon disulfide using a freezing stage at a temperature ranging from −30° to 0° C. The freezing procedure has allowed to produce only chitin or chitosan derivatives able to dissolve in an aqueous sodium hydroxide solution and suitable for application as additives in the manufacture of modified viscose fibres or as a spinning dope for the production of polyaminosaccharide fibres.

The freezing procedure in the case of polyaminosaccharides has been favourable in improving their reactivity with carbon disulfide by a suitable change of the super-molecular structure of chitin/chitosan.

However, the preparation of polyaminosaccharide viscose must be realized in a rather long period, and the use of the freezing procedure in typical industrial conditions has caused several difficulties, which frequently make the production impossible for realization in practice.

Well-known methods for the production of the viscose fibres containing chitosan as well as polyaminosaccharide fibres according to the viscose method are described among others in R. A. A. Muzzarelli's monography "Chitin", Pergamon Press, N.Y., 1977.

The well-known methods of polyaminosaccharide fibres production are based on the spinning of dissolved polymers into a regeneration bath or air.

Japanese Patent 81/112937 describes the production of chitosan fibres and films from an aqueous acid solution of chitosan. The spinning dope is filtered and spun through spinning nozzles and Coagulated in an aqueous solution of anionic surfactants. Alternatively, the dope is sprayed on a smooth surface and then immersed into a coagulation bath to form a film.

Japanese Patent 84/116418 discloses a production of chitosan fibres and films by dissolving chitosan into, a solution of dichloroacetic acid in water. The solution is formed into fibres or films in aqueous solutions of metal salts and the formed product is treated with chelating metals.

Japanese Patent No. 8/106901 describes a method for a chitosan fibres production, based on chitosan and its salts molded from aqueous solutions using a basic gelation bath. Chitosan flakes are dispersed in water and heated with acetic acid at 40° C. to give a dope containing 3% chitosan and 0.5% acetic acid. The dope is spun into a % alleous sodium hydroxide solution at a temperature of 30° C., washed and dried to manufacture 3.5 denier fibres with tenacity of 2.44 G/denier, elongation of 10.8% and knot strengh=of 1.7S G/denier.

European Patent Application EP 77.098 discloses a production of hollow chitosan fibres, useful for ultrafiltration and dialysis, with a diameter of 0.1–1 mm and a thickness of 0.005–0.025 mm. The hollow fibres are produced by spinning the solution into an alkaline coagulant bath through hollow-fiber spinnerets using gaseous ammonia.

Japanese Patent 85/059123 describes the spinning of chitosan fibres by extruding a solution of chitosan in an aqueous acetic acid and urea into a mixture of aqueous base and alcohol. The acetic acid and urea content in the spinning solution are 0.5 to 20 wt % and 0.1 to 10 wt %, respectively. The base bath is usually sodium hydroxide, potassium hydroxide or ammonium hydroxide used in a concentration of 1.0 to 50 wt %.

Japanese Patent 85/40224 describes the manufacture of chitosan fibres with improved tenacity and modulus. The fibres are prepared by spinning the aqueous acid solution of chitosan into air and by subsequently treating with gaseous ammonia and by washing, to obtain fibres with tenacity of 2 G/denier in a dry state, 0.82 G/denier in a wet state, elongation of 11% and modulus of 100 G/denier.

U.S. Pat. No. 4,309,534 also describes a preparation of renatured chitosan fibres and films. The agitation of chitosan in the presence of aqueous solution of acetic acid, glycolic acid and pyruvic acid for 2–14 days at room temperature allows to produce fibres for use in the production of transparent films and birefringent fibres.

The microcrystalline chitosan and method for its manufacture are described in the Polish Patent 125995. The product according to this method is formed in a form of gel-like dispersion or powder. Microcrystalline chitosan shows raised reactivity and water retention value WRV of 200–500% in the powder form and WRV of 500–2.000% in the gelatinous dispersion form, average molecular weight within a range of $10^4$–$10^6$ and deacetylation degree not less than 30%.

The microcrystalline chitosan is characterized by the same chemical structure as the standard chitosan raw material. However, it differs from this raw material by its super-molecular structure.

Finnish Patent 78126 describes the manufacture of chitosan-viscose fibres by introduction of an additive to a viscose dope, said additive being a microcrystalline chitosan derivative obtained with carbon disulfide, the additive being added in a concentration of not less than 0.1 wt % on α-cellulose weight, especially 0.5–25 wt %. The chitosan additive is produced by mercerization of microcrystalline chitosan in an alkaline solution, especially in an aqueous sodium hydroxide solution, whereafter the mercerized microcrystalline chitosan containing 1–10 wt % of polymer and 5–20 wt % of sodium hydroxide is reacted with carbon disulfide at a temperature not lower than 10° C. for 1–120 minutes.

Finnish Patent 78127 discloses the manufacture of chitosan-viscose fibres using the microcrystalline chitosan as the additive to viscose dope in a concentration of not less than 0.01 wt %, especially 0.01–30 wt %, on the weight of α-cellulose. The microcrystalline chitosan dispersion containing not less than 0.001 wt % of polymer is distributed into viscose, preferably by mixing for 1–60 minutes, and next the modified viscose is spun using standard conditions to obtain chitosan-viscose fibres characterized by superabsorbent and mild bacteriostatic behaviour as well as a better dyeability.

International Patent Application PCT/F190/00292 discloses modified viscose fibres comprising cellulose and containing in their structure only microcrystalline chitosan forming after spinning mainly hydrogen bonds with the regenerated cellulose of viscose fibres. The microcrystalline chitosan contains metal ions in order to modify and improve the properties of viscose fibres. The modified fibres contains not less than 0.01 wt % of microcrystalline chitosan, especially 0.1–20 wt %, and metal salts combined with chitosan in a form of chelate in a range of 0.001–2 wt %. The microcrystalline chitosan dispersion containing not less than 0.01 wt % of polymer, preferably 0.5–5.0 wt %, modified by chelatable metal ions such as copper, zinc or calcium, with a molar ratio of glucosamine unit to metal not higher than 1:2, is introduced and distributed into a viscose dope, preferably by mixing or by spurting before spinning and then a spinning of modified viscose fibres is realized. The modified viscose fibres after spinning are also subjected to after-treatment using a solution of chelatable metal ions such as copper, zinc or calcium, in a form of copper sulfate, zinc chloride or sulfate or calcium chloride.

The antibacterial modified viscose fibres containing chitosan under the trademark "Chitopoly" described in Japan Textile News, page 39, 1992 year and in Processing of Chitin/Chitosan Conference, Princenton, USA, 1991 are produced by introduction into a viscose dope the solid particles of standard chitosan and by spinning using polynosic viscose fibres technology.

The well-known methods of manufacture of modified viscose fibres containing chitosan using a traditional viscose method as well as the methods for manufacture of polyaminosaccharide fibres require a use of several complicated operations and ingredients for the preparation of the fibres. The well-known chitosan viscose fibres are characterized by special properties, such as as better dyeability and mild bioactivity including bacteriostaticity. The well-known chitosan-viscose fibres manufactured by introduction of microcrystalline chitosan, also in a form of chelates with several metal ions, are characterized by a structure not homogenized completely, affecting their mechanical properties as well as the bioactivity, The difficulties during the manufacture of well-known viscose fibres modified by microcrystalline chitosan, which may be also in the form of a chelate, are concerned with aggregation of microcrystalline chitosan particles, blocking of filtration fabrics or spinnerets and inhomogenity of microcrystalline chitosan distribution in the fibre structure, which all factors affect negatively also the fibre properties and behaviour.

The object of this invention is to improve the properties of the viscose fibres modified with chitosan and to offer a method for their manufacture which is not concerned with the drawbacks presented hereinabove.

According to the present invention, the modified viscose fibres contain in their structure microcrystalline chitosan and a water-soluble and/or alkali-soluble natural polymers or derivative thereof. The said natural polymer or derivative thereof has a chemical structure different from that of chitosan and is composed or monomer units containing groups capable of creating ionic and/or hydrogen bonds with the microcrystalline chitosan. Examples of such polymers, which are of polysaccharide origin, are alginates and carboxymethylcellulose. In order to form the bonds with the microcrystalline chitosan, the monomer units of these polymers should contain OH groups, carboxyl groups and/or amine groups.

The amount of microcrystalline chitosan is preferably not less than 0.001 wt %, especially 0.1–10.0 wt %, and the total amount of the water-soluble and/or alkali soluble natural polymer or derivative thereof is not less than 0.001 wt %, especially 0.1–10.0 wt %, 50–90 wt % being of α-cellulose, and the remainder being water and finishing agents.

The modified viscose fibres can be produced by direct application to the viscose of the modified microcrystalline chitosan containing said water-soluble and/or alkali-soluble natural polymer or derivative thereof, especially in a form of dispersion, by the application of the microcrystalline chitosan dispersion and the said polymer or derivative thereof separately to the viscose, or by direct creation of microcrystalline chitosan in statu nascendi in the viscose during mixing and/or spurting of the powdered chitosan salts and said polymer or derivative thereof.

According to the invention the modified microcrystalline chitosan which is used for modification of viscose fibres, such as in a dispersion form preferably in water, containing in its structure the water-soluble and/or alkali-soluble natural polymers or derivatives thereof, in a total content not lower than 0.1 wt %, preferably 1.0–100 wt % on a weight of microcrystalline chitosan, is characterized by water retention value (WRV) in a dispersion form within a range of 1000–10000%, average molecular weight of chitosan ranging from $10^3$ to $10^6$, deacetylation degree of chitosan not lower than 30%; especially 50–90%, average particle dimension of microcrystalline chitosan in a range of 0.1–50 μm, and polymer content in dispersion not lower than 0.01 wt %, preferably 0.1–10.0 wt %.

In accordance with a preferred embodiment of the method of the invention the modified microcrystalline chitosan is manufactured by introduction of the water-soluble and/or alkali-soluble natural polymer or derivative thereof, to the structure of standard microcrystalline chitosan, said polymer or derivative thereof being added in a form of powder and/or solution, preferably by intensive mixing or homogenization for a time of minimum 1 minute, preferably 3–10 minutes.

In accordance with a preffered embodiment of the method of the invention the modified microcrystalline chitosan containing the water-soluble and/or alkali-soluble natural polymer or derivative thereof, preferably in a form of dispersion, is distributed into the viscose, especially by mixing for a time within a range of 1–30 minutes or spurting before spinning, whereafter optionally the mixture is filtered and next the spinning of the modified viscose fibres is realized.

In accordance with a preferred embodiment of the method of the invention the modifying water-soluble and/or alkali-soluble natural polymer or derivative thereof, is introduced independently of the chitosan-based microcrystalline polymer before, together with and/or after its introduction to the viscose, preferably in a solid or solution form. After the distribution into the viscose, especially by mixing for a time within a range of 1–30 minutes and filtration, the mixture is spinned to obtain the modified viscose fibres.

In accordance with the invention, the introduction of modified microcrystalline chitosan containing the water-soluble and/or alkali soluble natural polymer or derivative thereof, or standard microcrystalline chitosan with the addition before, together with or after the water-soluble and/or alkali-soluble natural polymer or derivative thereof, can be realized by preparation of a concentrate of modified microcrystalline chitosan in the viscose, containing 1–99 wt % of modified microcrystalline chitosan, the remainder being the natural polymers or derivatives thereof dissolved in the viscose, and the viscose, using a mixing or spurting system, especially for 1–30 minutes, whereafter the viscose concentrate modified by microcrystalline chitosan and by the water-soluble and/or alkali-soluble natural polymer or derivative thereof is introduced into a viscose dope by mixing or spurting and the modified viscose fibres are manufactured from said dope.

According to the present invention the modified microcrystalline chitosan used for modification of viscose fibres can be also created in statu nascendi in the viscose by introduction of chitosan salts, such as chitosan hydrochloride or chitosan acetate, preferably in the form of solid powder, possibly mixed with the suitable water-soluble and/or alkali-soluble natural polymer or derivative thereof, also in a powder form, during intensive homogenization of mixture of viscose with the introduced substances, preferably at minimum 100 r.p.m. The microcrystalline chitosan in the viscose is created for a time of 1–60 minutes, whereafter optionally the mixture is filtered and next the spinning of the modified viscose fibres is realized.

In accordance with a preferred embodiment of the method of the invention, the modifying water-soluble and/or alkali-soluble natural polymers or derivatives thereof introduced before, together with or after the addition of the chitosan salts are applied in a total content not lower than 0.1 wt %, preferably 1.0–100 wt % on the weight of the microcrystalline chitosan.

In accordance with an embodiment of the invention, the introduction of chitosan salts with the water-soluble and/or alkali-soluble natural polymer or derivative thereof, which are added as a mixture with the chitosan salts or before or after them to the viscose, can also be realized by the manufacture of the viscose concentrate containing microcrystalline chitosan created in statu nascendi in the viscose and containing the water-soluble and/or alkali-soluble natural polymer or derivative thereof dissolved in the viscose, whereby the viscose concentrate contains 1–99 wt % of modified microcrystalline chitosan, the remainder being the dissolved natural polymers and viscose. The manufacturing is performed especially using mixing or spurting system for 1–30 minutes, whereafter the viscose concentrate containing modifying substances is introduced to a viscose dope by mixing or spurting and the modified viscose fibres are manufactured.

The modified viscose fibres according to the invention contain in their structure the regenerated cellulose, microcrystalline chitosan and as a third component other natural polymers or derivatives thereof characterized by solubility in water and/or alkali, such as alginates or carboxymethylcellulose, usually forming complexes or second order bond type of compounds with chitosan. The specific structure of modified viscose fibres containing at least three different natural polymers and/or their derivatives, such as regenerated cellulose, chitosan and water-soluble and/or alkali-soluble natural polymers, is able to incorporate these latter soluble polymeric materials during spinning and finishing time through creation of suitable connexion between microcrystalline chitosan and the above polymers already in the viscose as well as at the time of spinning.

New original modified viscose fibres containing microcrystalline chitosan and other natural polymers or derivatives thereof according to the invention are characterized by several advantages in comparison to well-known fibres, among other things higher absorbance of water or dyes, higher bioactivity and softness.

Up to now it has not been known a possibility to manufacture viscose fibres containing in their structure water-soluble and/or alkali-soluble natural polymers or derivatives thereof tending to be washed out during the spinning and finishing processes.

The microcrystalline chitosan used as the raw modifying material for the viscose fibres according to the invention can reduce its average particle size by application of the water-soluble and/or alkali-soluble natural polymer or derivative thereof making possible a suitable reduction of particle size during homogenization as well as during creation of different types of connexions between microcrystalline chitosan and this polymer. This last phenomenon creates a possibility to increase the protection against secondary agglomeration of microcrystalline chitosan particles.

The modified microcrystalline chitosan particles are more flexible than standard microcrystalline polymer particles and, at the same time, they are characterized by higher ability to disintegrate to individual particles under mechanical action or to deform their shape under a suitable tension during the spinning process. At the same time special behaviour of microcrystalline chitosan allows to create its modificates by suitable co-reaction during the introduction of the water-soluble and/or alkali soluble natural polymer or derivative thereof to its liquid dispersion, both in solid or liquid forms, or directly also in a viscose dope where the microcrystalline chitosan is dispersed and the other natural polymers become dissolved.

The main advantage of the modified viscose fibres according to the invention is concerned with introduction of microcrystalline chitosan modified by the water-soluble and/or alkali-soluble natural polymer or derivative thereof directly to their structure to create suitable special properties of fibres, such as high absorption and bioactivity in at least the three components of the fibres.

The method of the manufacture of the modified fibres according to the invention is concerned with direct introduction of modified microcrystalline chitosan containing the water-soluble and/or alkali-soluble natural polymer or derivative thereof usually in the form of complex and/or second order bond type of compounds into the viscose dope and its excellent distribution in this medium. A benefit of the modified microcrystalline chitosan, especially in a gel-like dispersion form, is concerned with its very high stability and extraordinary mixability with viscose in a very wide range of concentration without any negative effect on the viscose stability and spinning properties. The use of the natural polymers or derivatives thereof improves the distribution of microcrystalline chitosan particles with the consequent improvment of modified viscose fibres properties, such as tenacity or loop tenacity, in comparison to the viscose fibres modified only by standard microcrystalline chitosan. The method according to the invention allows to introduce the said polymers also independently to the viscose dope before, together or after the addition of microcrystalline chitosan. A similar effect as with the introduction of modified microcrystalline chitosan is obtained. One of the advantages of the invented method is concerned with the ability to create a viscose concentrate containing microcrystalline chitosan and said natural polymers or derivatives thereof. The above mentioned concentrate improves the distribution of microcrystalline chitosan as well as the distribution of the additives in the viscose dope.

The modification of viscose fibres by microcrystalline chitosan and the water-soluble and/or alkali-soluble natural polymer or derivative thereof in accordance with the invented method allows to obtain special viscose fibres in the industrial scale using standard viscose technology with existing equipment.

The modification of viscose fibres according to the invention is realized also by the creation of microcrystalline chitosan using an "in statu nascendi" method in viscose by introduction of suitable chitosan salts, especially in mixture with the water-soluble and/or alkali-soluble natural polymer or derivative thereof. The chitosan salts applied to the alkaline viscose with intensive homogenization create the microcrystalline chitosan in statu nascendi during their hydrolysis and precipitation and effect an adequate connexion to the microcrystalline chitosan by the introduced polymer. One of the advantages of the method according to the invention is the ability to manufacture a viscose concentrate containing microcrystalline chitosan created in statu nascendi and further containing said polymers. This concentrate is much better distributed in an industrial-scale viscose dope with much lower size of microcrystalline chitosan particles.

The methods in accordance with the invention are uncommonly simple and easy for practical application in comparison to well-known methods. The modified viscose fibres obtained in accordance with the invention are characterized by several advantages in comparison to the standard viscose fibres as well as the viscose fibres containing only microcrystalline chitosan. The fibres containing at least 3 types of polymers: regenerated cellulose, microcrystalline chitosan and, combined with the chitosan, natural polymer or derivative thereof according to the invention, are characterized by higher tenacity, especially loop tenacity, higher sorption of water and dyes, special behaviour such as bacteriostacity, bioactivity or wound healing.

Introduction of the modified microcrystalline chitosan to the viscose fibres in accordance with the invention allows to affect their structure in dependence of the modified microcrystalline chitosan composition, content, type of the modifying natural polymers and/or their derivatives, and the spinning parameters used.

The most important advantage of the invention is concerned with a high degree of microcrystalline chitosan retained in the fibre structure. This parameter in the case of modified microcrystalline chitosan is very often equal to 100%, whereas the unmodified microcrystalline chitosan is washed out from the fibres during spinning and finishing in percentage of 50 or more calculated on the initially introduced amount.

The modified viscose fibres containing the composition of microcrystalline chitosan with said natural polymer or derivative thereof are characterized by a much higher developed intrinsic surface related to the action of these components with the fibres of regenerated cellulose. The suitably low amount of these natural polymers or derivatives thereof used for the modification of microcrystalline chitosan and the viscose fibres, remaining in their structure as well as releasing during the spinning and finishing process, create soft and sorption active intrinsic fibre surface suitable also for penetration by enzymes degrading microcrystalline chitosan during the practical use as the antibacterial fibres. The discussed properties of the modified viscose fibres are not active in the case of these fibres with standard microcrystalline chitosan.

The method according to the invention allows to manufacture modified viscose fibres with special properties suitable above all for medical and sanitary uses such as tampons, bandages, hospital textiles or wound dressings. The object is further to develop modified viscose fibres that can be used for medical, pharmaceutical, sanitary or textile applications to produce fabrics, knitwears, non-wovens and sanitary or medical cellulosic wool with special behaviour.

The following methods for the determination of properties of the viscose fibres as well as microcrystalline chitosan have been used:

- average molecular weight of chitosan: according to a method described in "Chitin" Pergamon Press, N.Y., 1977
- nitrogen content: according to standard Kjehdhal method
- water retention value: according to the method described in the Journal of Applied Polymer Science, v. 33, p. 177, 1987
- deacetylation degree of chitosan: according to the potentiometric titration method
- energy of hydrogen bonds: according to the method described in the Cellulose Chemistry and Technology, V. 7, p. 153, 1973
- the mechanical properties of viscose fibres: according to the Polish standards.

The standard processes of spinning of viscose fibres as well as standard finishing methods were used for the manufacture of modified viscose fibres.

The invention is explained further in the following examples which do not restrict the scope of the appended claims.

EXAMPLE 1

150 parts by weight of microcrystalline chitosan in a form of aqueous dispersion containing 3.27 wt % of polymer and characterized by average molecular weight of Mw=1.28×$10^5$, water retention value of WRV=1.280%, deacetylation degree of DD=69.5%, energy of hydrogen bonds in a form of film of $E_H$ =18.1 kJ/mol, nitrogen content of 7.4% and average particle dimension in a range of 10–30 μm was mixed for 30 minutes with 150 r.p.m with 0.05 parts by weight of mannuronic rich sodium alginate introduced in a form of fine powder. Then the modified microcrystalline chitosan characterized by presence of mannuronic rich sodium alginate joined to a chitosan by strong hydrogen bonds with their energy in a form of film of $E_H$=21.5 kJ/mol and average particle dimension in a range of 10–20 μm was introduced into 1105 parts by weight of viscose characterized by α-cellulose content of 9 wt %, sodium hydroxide content of 5.7 wt % viscosity of 80 s. with continous stirring with 100 r.p.m for 15 minutes. Next the modified viscose was deaerated to remove of the air-bubbles, filtered and the standard spinning process was applied to the modified viscose fibres as well as to the standard viscose fibres serving as a reference.

The spinning of viscose fibres was carried out with a speed of 20 m/min. with streching of 153% for a first bath containing solution of sulfuric acid in a concentration of 90 g/l and zinc sulfate of 35 g/l at 40° C. and three washing bath with warm water of 90° C. in a first one and a cold water for next baths. The fibres obtained were finished in the standard conditions.

The modified microcrystalline chitosan dispersed in a viscose was characterized by average particle dimension in a range of 5–20 μm. The modified viscose fibres obtained characterized by presence in their structure of microcrystalline chitosan and mannuronic rich alginate containing 0.30 wt % of nitrogen responsive to 4.05 wt % of chitosan were characterized by thickness of 7.75 dtex, tenacity of 15.5 cN/tex, loop tenacity of 7.03 cN/tex and elongation of 28%. The standard viscose fibres obtained in the same conditions with stretching of 200% were characterized by thickness of 2.80, tenacity of 23.6 cN/tex, loop tenacity of 5.45 cN/tex, elongation of 18% and nitrogen content of 0%.

EXAMPLE 2

272 parts by weight of microcrystalline chitosan with properties described in Example 1 was mixed with 0. 445 parts by weight of mannuronic rich sodium alginate introduced in a form of fine powder for 45 minutes with 200 r.p.m.

Then the modified microcrystalline chitosan characterized by presence of mannuronic rich sodium alginate joined to a chitosan by strong hydrogen bonds with their energy in a form of film of $E_H$ =21.9 kJ/mol and average particle dimension in a range of 5–20 μm was introduced into 505 parts by weight of viscose with properties as in Example 1 with continous mixing for 30 minutes with 150 r.p.m to obtain a modified viscose concentrate of microcrystalline chitosan and sodium alginate.

Then the viscose concentrate was introduced with stirring into 600 parts by weight of viscose and after 15 minutes the modified viscose was deaerated, filtered and spinned to obtain the modified viscose fibres. The modified microcrystalline chitosan dispersed in a viscose was characterized by average particle dimension in a range of 5–15 μm. The spinning and finishing procedure was as in Example 1 with streching of 152%. The modified viscose fibres obtained characterized by presence in their structure of microcrystalline chitosan and mannuronic rich alginate containing 0.7 wt % of nitrogen responsive to 8.9 wt % of chitosan were characterized by thickness of 8.16 dtex, tenacity of 17.3 cN/tex, loop tenacity of 7.66 cN/tex and elongation of 25%.

The standard viscose fibres were characterized by properties as in Example 1.

EXAMPLE 3

400 parts by weight of microcrystalline chitosan in a form of aqueous dispersion containing 4.59 wt % of polymer and characterized by average molecular weight of Mw=1,28×$10^5$, DD=60.5%, WRV=1.280%, nitrogen content of 7.5%, $E_H$ of film of 17.9 kJ/mol and average particle dimension in a range of 20–50 μm was mixed for 30 minutes with 100 r.p.m with 0.55 parts by weight of fine powdered sodium carboxymethylcellulose of water dissolving grade. Then the modified microcrystalline chitosan characterized by presence of sodium carboxylmethylcellulose joined to a chitosan by strong hydrogen bonds with their energy in a form of film of $E_H$=20.4 kJ/mol and average particle dimension in a range of 10–40 μm was introduced into 4158 parts by weight of viscose characterized by α-cellulose content of 8.83 wt %, sodium hydroxide content of 5.89 wt % and viscosity of 44 s with continous stirring for 40 minutes with 100 r.p.m. Next the modified viscose was deaerated, filtered and a spinning was carried out with a speed of 40 m/min. with streching of 30% using two regeneration baths containing in first bath of 130 g/l sulfuric acid, 300 g/l sodium sulfate and 5 g/l zinc sulfate at 48°–50° C. and in second bath of 15 g/l sufuric acid at 60° C. and next a washing bath containing water at temperature of 90° C. The viscose fibres obtained were then finished as the typical staple viscose fibres.

The modified microcrystalline chitosan dispersed in a viscose was characterized by average particle dimension in a range of 5–40 μm.

The modified viscose fibres obtained characterized by presence in their structure of microcrystalline chitosan and carboxymethylcellulose containing 0.30 wt % of nitrogen responsive to 4.0 wt % of chitosan were characterized by thickness of 15.2 dtex, tenacity of 8.95 cN/tex, loop tenacity of 5.49 cN/tex and elongation of 40%. The standard viscose fibres obtained in the same conditions were characterized by thickness of 3.52 dtex, tenacity of 24.3 cN/tex, loop tenacity of 8.55 cN/tex and elongation of 25% as well as nitrogen content of 0%.

EXAMPLE 4

370 parts by weight of microcrystalline chitosan in a form of aqueous dispersion with properties as in Example 3 was homogenized for 120 minutes with 300 r.p.m with 1.697 parts by weight of fine powdered sodium carboxymethylcellulose of water dissolving grade. Then the modified microcrystalline chitosan characterized by presence of sodium carboxymethylcellulose joined to chitosan by strong hydrogen bonds with their energy in a form of film of $E_H$=21.0 kJ/mol and average particle dimension in a range of 10–50 μm was introduced to 1000 parts by weight of viscose with properties such as in Example 3 with continous mixing for 10 minutes to obtain a viscose concentrate containing microcrystalline chitosan and sodium carboxymethylcellulose. Then the viscose concentrate was mixed for 40 minutes with 100 r.p.m with 1230 parts by weight of the same viscose and the modified viscose was deaerated and filtered. The spinning of the modified viscose fibres was carried out as in Example 3.

The modified viscose fibres obtained characterized by presence of microcrystalline chitosan and carboxymethylcellulose in their structure containing 0.65 wt % of nitrogen responsive to 8.5 wt % of chitosan were characterized by thickness of 9.92 dtex, tenacity of 4.33 cN/tex, loop tenacity of 2.32 cN/tex and elongation of 34%.

The standard viscose fibres were characterized by properties as in Example 3.

EXAMPLE 5

400 parts by weight of microcrystalline chitosan in a form of aqueous dispersion with properties as in Example 3 was homogenized for 30 minutes with 400 r.p.m with 0.367 parts by weight of guluronic rich sodium alginate. Then the modified microcrystalline chitosan characterized by presence of guluronic rich sodium alginate joined to a chitosan by strong hydrogen bonds with their energy in a form of film of $E_H$=20.4 KJ/mol and average particle dimension of 10–25 μm was introduced into 1500 parts by weight of viscose with properties as in Example 3 with stirring for 15 minutes to obtain a viscose concentrate containing microcrystalline chitosan and guluronic rich sodium alginate. Then the viscose concentrate was mixed for 70 minutes with 6500 parts by weight of the same viscose and the modified viscose was deaerated and filtered. The spinning of modified viscose fibres was carried out as in Example 3.

The modified microcrystalline chitosan dispersed in viscose was characterized by average particle dimension in a range of 5–20 μm.

The modified viscose fibres obtained characterized by presence in their structure of microcrystalline chitosan and guluronic rich alginate containing 0.2 wt % of nitrogen responsive to 2.6 wt % of chitosan were characterized by thickness of 9.87 dtex, tenacity of 16.7 cN/tex, loop tenacity of 8.76 cN/tex and elongation of 39%. The standard viscose fibres were characterized by properties as in Example 3.

EXAMPLE 6

3.54 parts by weight of chitosan hydrochloride characterized by nitrogen content of 6.9 wt %, deacetylation degree of 70%, viscosity of 680 mPas in 1 wt % solution and particle size of 60 mesh, was continously introduced with intensively stirring for 30 minutes with 500 r.p.m to 328 parts by weight of viscose with properties as in Example 1. The homogenization was continuated for next 30 minutes and the viscose concentrate containing microcrystalline chitosan created in statu nascendi was then introduced with stirring for 15 minutes with 100 r.p.m to 500 parts by weight of viscose with the same properties. The modified viscose obtained was next deaerated and filtered. The spinning of modified viscose fibres was carried out as in Example 1.

The modified viscose was characterized by average particle dimension of microcrystalline chitosan in a range of 15–50 μm.

The modified viscose fibres characterized by presence of microcrystalline chitosan in their structure containing 0.10 wt % of nitrogen responsive to 1.45 wt % of chitosan were characterized by thickness of 7.51 dtex, tenacity 5.02 cN/tex and elongation of 45%. The standard viscose fibres were characterized by properties as in Example 1.

EXAMPLE 7

Mixture of 4.725 parts by weight of chitosan hydrocloride with properties as in Example 6 and 4.725 parts by weight of mannuronic rich sodium alginate was continously introduced for 30 minutes with intensively stirring with 600 r.p.m to 828 parts by weight of viscose with properties as in Example 1. Then the modified viscose containing microcrystalline chitosan created in statu nascendi and mannuronic rich sodium alginate was deaerated and filtered. The spinning process was carried out as in Example 1.

The modified viscose was characterized by microcrystalline chitosan particle dimension in a range of 10–40 μm.

The modified viscose fibres characterized by presence of microcrystalline chitosan joined with mannuronic rich sodium alginate containing 0.2 wt % of nitrogen responsive to 2.9 wt % of chitosan were characterized by thickness of 8.01 dtex, tenacity of 7.5 cN/tex and elongation of 39%.

The standard viscose fibres were characterized by properties as in Example 1.

We claim:

1. Modified viscose fibers comprising regenerated cellulose and containing in their structure microcrystalline chitosan bound mainly by hydrogen bonds with the regenerated cellulose of viscose fibers, the modified fibers containing as a third component a water-soluble or alkali-soluble or both water and alkali-soluble natural polymer or its derivative or mixtures thereof, of polysaccharide origin, and comprising the presence in its structure of groups capable of creating ionic bonds or hydrogen bonds or both with said microcrystalline chitosan.

2. Modified viscose fibers as claimed in claim 1, wherein said natural polymer or its derivative is selected from the group consisting of alginic acid, sodium alginate, potassium alginate and sodium carboxymethylcellulose.

3. Modified viscose fibers as claimed in claim 1, wherein the percentage of microcrystalline chitosan is not less than 0.001 wt. %, the content of said natural polymer or its derivatives of polysaccharide origin is not lower than 0.001 wt %, %, and the content of α-cellulose is 50–90 wt. %, the remainder being water and finishing agents.

4. Modified viscose fibers as claimed in claim 3, wherein the percentage of microcrystalline chitosan is 0.1–10.0 wt. % and the content of said natural polymer or its derivatives of polysaccharide origin is 0.1–10.0 wt. %.

5. Method for manufacture of modified viscose fibers, wherein the manufacture comprises the steps of forming a viscose dope, and spinning the viscose into a bath to form the viscose fibers, the viscose fibers being modified with microcrystalline chitosan by introducing microcrystalline chitosan into the viscose before the spinning step and the spinning being carried out to form viscose fibers containing regenerated cellulose and microcrystalline chitosan forming hydrogen bonds with the structure of the regenerated cellulose, the microcrystalline chitosan being modified by introducing to the viscose before the spinning step of a water-soluble or alkali-soluble or both water-soluble and alkali-soluble natural polymer or a derivative thereof or mixture thereof, of polysaccharide origin, which comprises in its structure of groups capable of creating ionic bond or hydrogen connections or both with said microcrystalline chitosan, and spinning the viscose into the bath to form said modified viscose fibers.

6. Method as claimed in claim 5, wherein said natural polymer or derivative thereof is selected from the group consisting of alginic acid, sodium alginate, potassium alginate and sodium carboxymethylcellulose.

7. Method as claimed in claim 5, wherein the said polymer or derivative thereof is added in a form of powder or solution or both to the microcrystalline chitosan, by intensive mixing or homogenization for a time of at least 1 minute, whereafter the modified microcrystalline chitosan is introduced into the viscose.

8. Method as claimed in claim 7, wherein the modified microcrystalline chitosan in dispersion form used for the modification of viscose fibers, containing in its structure said natural polymer or derivative or both, of polysaccharide origin, in a total content of 1.0–100 wt. % based on the weight of microcrystalline chitosan, and comprising a water retention value in dispersion form within a range of 1000–10000, average molecular weight of chitosan ranging from $10^3$ to $10^6$, deacetylation degree of chitosan not lower than 30%, average particle dimension of microcrystalline chitosan in a range of 0.1–50.0 μm, and polymer content in dispersion not lower than 0.01 wt. %.

9. Method as claimed in claim 5, wherein the modifying natural polymer or its derivative or both, of polysaccharide origin, is introduced independently of the microcrystalline chitosan at least one of before, together with or after its introduction to the viscose, to form a mixture of viscose, microcrystalline chitosan and the modifying natural polymer or its derivative or both, and after the distribution into the viscose, the mixture is spun to obtain the modified viscose fibers.

10. Method as claimed in claim 9, wherein said natural polymer or its derivative or both is introduced in solid or solution form.

11. Method as claimed in claim 7, wherein the introduction of the modified microcrystalline chitosan containing the natural polymer or derivative thereof or mixture, or the introduction of the standard microcrystalline chitosan with the addition before, together with, and/or after the natural polymer or derivative thereof or mixture to the viscose, is realized by preparation of a concentrate of the modified microcrystalline chitosan in viscose, containing 1–99 wt. % of the modified microcrystalline chitosan, the remainder being the natural polymer or derivative or both thereof dissolved in the viscose, and viscose, the introduction into the concentrate being effected using a mixing or spurting system, whereafter the viscose concentrate containing the modified microcrystalline chitosan and the natural polymer or its derivative or both is introduced into a viscose dope by mixing or spurting and the modified viscose fiber is manufactured from said dope.

12. Method as claimed in claim 5, wherein the modified microcrystalline chitosan is created in statu nascendi in the viscose by introducing a chitosan salt during intensive homogenization of the mixture of viscose with the introduced substances, whereby microcrystalline chitosan is created in the viscose for a time of 1–60 minutes, the modifying natural polymer or derivative thereof or mixture thereof, of polysaccharide origin, being added to the viscose at least one of before, together with or after the introduction of the chitosan salt.

13. Method as claimed in claim 12, wherein the chitosan salt is selected from a group consisting of chitosan hydrochloride and chitosan acetate.

14. Method as claimed in claim 12, wherein the chitosan salt is added in the form of a solid powder together with the natural polymer or derivative thereof or mixture thereof, of polysaccharide origin, which is also in the form of a solid powder.

15. Method as claimed in claim 12, wherein the modifying natural polymer or derivative thereof or mixture thereof, of polysaccharide origin, introduced before, together with and/or after the addition of the chitosan salt are applied in a total content of 1.0–100 wt. % on the weight of microcrystalline chitosan.

16. Method as claimed in claim 12, wherein the introduction of the chitosan salt and the natural polymer or derivative thereof or mixture thereof, of polysaccharide origin, to the viscose is realized by manufacturing a viscose concentrate, containing microcrystalline chitosan created in statu nascendi and the natural polymer or derivative thereof or mixture thereof dissolved in the viscose, the said concentrate containing 1–99 wt. % of the modified microcrystalline chitosan, the remainder being the natural polymer or derivative thereof or mixture thereof dissolved in the viscose, and viscose, the introduction into the concentrate being effected using a mixing or spurting system, whereafter the viscose concentrate containing the modified microcrystalline chitosan and the natural polymer or derivative thereof or mixture thereof is introduced into a viscose dope by mixing or spurting and the modified viscose fiber is manufactured.

17. Method as claimed in claims 8, wherein the introduction of the modified microcrystalline chitosan containing the natural polymer or derivative thereof or mixture thereof, or the introduction of the standard microcrystalline chitosan with the addition before, together with, and/or after the natural polymer or derivative thereof or mixture thereof to the viscose, is realized by preparation of a concentrate of the modified microcrystalline chitosan in viscose, containing 114 99 wt.% of the modified microcrystalline chitosan, the remainder being the natural polymer or derivative thereof or mixture thereof dissolved in the viscose, and viscose, the introduction into the concentrate being effected using a mixing or spurting system, whereafter the viscose concentrate containing the modified microcrystalline chitosan and the natural polymer or derivative thereof or mixture thereof is introduced into a viscose dope by mixing or spurting and the modified viscose fiber is manufactured from said dope.

18. Method as claimed in claim 9, wherein the introduction of the modified microcrystalline chitosan containing the natural polymer or derivative thereof or mixture thereof, or the introduction of the standard microcrystalline chitosan with the addition before, together with, and/or after the natural polymer or derivative thereof or mixture thereof to the viscose, is realized by preparation of a concentrate of the modified microcrystalline chitosan in viscose, containing 1–99 wt. % of the modified microcrystalline chitosan, the remainder being the natural polymer or derivative thereof or mixture thereof dissolved in the viscose, and viscose, the introduction into the concentrate being effected using a mixing or spurting system, whereafter the viscose concentrate containing the modified microcrystalline chitosan and the natural polymer or derivative thereof or mixture thereof is introduced into a viscose dope by mixing or spurting and the modified viscose fiber is manufactured from said dope.

19. Method as claimed in claim 14, wherein the modifying natural polymer or derivative thereof or mixture thereof, of polysaccharide origin, introduced before, together with and/or after the addition of the chitosan salt are applied in a total content of 1.0–100 wt. % based on the weight of microcrystalline chitosan.

20. Method as claimed in claim 14, wherein the introduction of the chitosan salt and the natural polymer or derivative thereof or mixture thereof, of polysaccharide origin, to the viscose is realized by manufacturing a viscose concentrate, containing microcrystalline chitosan crated in statu nascendi and the natural polymer or derivative thereof or mixture thereof dissolved in the viscose, the said concentrate containing 1–99 wt. % of the modified microcrystalline chitosan, the remainder being the natural polymer or derivative thereof or mixture thereof dissolved in the viscose, and viscose, the introduction into the concentrate being effected using a mixing or spurting system, whereafter the viscose concentrate containing the modified microcrystalline chitosan and the natural polymer or derivative thereof or mixture thereof is introduced into a viscose dope by mixing or spurting and the modified viscose fiber is manufactured.

21. Method as claimed in claim 15, wherein the introduction of the chitosan salt and the natural polymer or derivative thereof or mixture thereof, of polysaccharide origin, to the viscose is realized by manufacturing a viscose concentrate, containing microcrystalline chitosan crated in statu nascendi and the natural polymer or derivative thereof or mixture thereof dissolved in the viscose, the said concentrate containing 1–99 wt. % of the modified microcrystalline chitosan, the remainder being the natural polymer or derivative thereof or mixture thereof dissolved in the viscose, and viscose, the introduction into the concentrate being effected using a mixing or spurting system, whereafter the viscose concentrate containing the modified microcrystalline chitosan and the natural polymer or derivative thereof or mixture thereof is introduced into a viscose dope by mixing or spurting and the modified viscose fiber is manufactured.

* * * * *